US009562501B2

(12) United States Patent
Takada et al.

(10) Patent No.: US 9,562,501 B2
(45) Date of Patent: Feb. 7, 2017

(54) BLOW-BY GAS PROCESSING CIRCUIT FOR INTERNAL COMBUSTION ENGINE

(71) Applicant: HONDA MOTOR CO., LTD., Minato-ku, Tokyo (JP)

(72) Inventors: Hideaki Takada, Wako (JP); Hibiki Koga, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 20 days.

(21) Appl. No.: 14/087,614

(22) Filed: Nov. 22, 2013

(65) Prior Publication Data

US 2014/0158101 A1 Jun. 12, 2014

(30) Foreign Application Priority Data

Dec. 10, 2012 (JP) ..... 2012-269161

(51) Int. Cl.
*F01M 13/00* (2006.01)
*F02M 35/10* (2006.01)
*F01M 13/02* (2006.01)

(52) U.S. Cl.
CPC ..... *F02M 35/10222* (2013.01); *F01M 13/025* (2013.01)

(58) Field of Classification Search
CPC ..... F02M 13/022; F02M 35/10222; F01M 13/025
USPC ..... 123/572–574
See application file for complete search history.

(56) References Cited

U.S. PATENT DOCUMENTS

| | | | | |
|---|---|---|---|---|
| 3,167,060 | A * | 1/1965 | Fowler et al. | 123/572 |
| 3,589,347 | A * | 6/1971 | Sawada | 123/574 |
| 3,946,710 | A | 3/1976 | Albano et al. | |

FOREIGN PATENT DOCUMENTS

| | | | |
|---|---|---|---|
| JP | 49-6326 | A | 1/1974 |
| JP | 56-35545 | U | 4/1981 |
| JP | 59-158307 | A | 9/1984 |
| JP | 1-115813 | U | 8/1989 |
| JP | 2-63015 | U | 5/1990 |
| JP | H03-33417 | A | 2/1991 |

(Continued)

OTHER PUBLICATIONS

European Search Report dated Jan. 20, 2014, of corresponding European Patent Application No. 13196322.

(Continued)

*Primary Examiner* — Marguerite McMahon
(74) *Attorney, Agent, or Firm* — Westerman, Hattori, Daniels & Adrian, LLP

(57) ABSTRACT

A blow-by gas processing circuit for an internal combustion engine includes a blow-by gas lead-out pipe uprising from the engine and extending along one side surface of an air cleaner, an upper pipe bending laterally from an upper end of the lead-out pipe and extending along the one side surface, a descending pipe bending downward from an extremity portion of the upper pipe and extending along the one side surface to reach a purification completion chamber of the cleaner, a branch pipe branching downward from an intermediate portion of the upper pipe and connected to a blow-by gas outlet port opened to an intake passage penetrating an insulator member, and a control valve placed in an upper portion of the branch pipe and opening responding to a rise in boost negative pressure of the engine.

7 Claims, 5 Drawing Sheets

(56) References Cited

FOREIGN PATENT DOCUMENTS

| | | | |
|---|---|---|---|
| JP | 4-47116 | U | 4/1992 |
| JP | 2005-226510 | A | 8/2005 |
| JP | 2011-102547 | A | 5/2011 |
| JP | 2012-503745 | A | 2/2012 |

OTHER PUBLICATIONS

Communication pursuant to Article 94(3) EPC dated Apr. 14, 2015, issued in corresponding European Application No. 13 196 322.5. (5 pages).
Office Action dated Jun. 10, 2015, issued in counterpart Japanese application No. 2012-269161 (3 pages).

* cited by examiner

IDLE TO LOW-LOAD OPERATION

MEDIUM-LOAD OPERATION

FULL-LOAD OPERATION

BLOW-BY GAS PROCESSING CIRCUIT FOR INTERNAL COMBUSTION ENGINE

BACKGROUND OF THE INVENTION

Field of the Invention

The present invention relates to a blow-by gas processing circuit for an internal combustion engine, in which a carburetor having an intake passageway extending laterally is connected to one side surface of an internal combustion engine with an insulator member interposed between the carburetor and the one side surface, and an air cleaner placed above the carburetor is connected to an upstream end of the carburetor.

Description of the Related Art

As disclosed in Japanese Patent Application Laid-open No. 3-33417, a generally-used blow-by gas processing circuit for an internal combustion engine conventionally includes: a first blow-by gas lead-out pipe extending out from the internal combustion engine so as to reach a purification completion chamber of an air cleaner; a control valve attached to an intake pipe of the internal combustion engine to which a carburetor is connected, and configured to open in accordance with a rise in boost negative pressure of the internal combustion engine; and a second blow-by gas lead-out pipe extending out from the internal combustion engine to be connected to the control valve.

SUMMARY OF THE INVENTION

In the conventional blow-by gas processing circuit for an internal combustion engine, the control valve is attached to the intake pipe which is relatively long, and the attachment is not interfered with by any other parts. For this reason, the attachment is easy. Accordingly, it is difficult to apply this configuration to an internal combustion engine whose intake pipe is not long.

The present invention has been made with the foregoing circumstance taken into consideration. An object of the present invention is to provide a blow-by gas processing circuit for an internal combustion engine which is applicable to various types of internal combustion engines regardless of whether or not their intake pipes are long.

In order to achieve the object, according to a first aspect of the present invention, there is provided a blow-by gas processing circuit for an internal combustion engine, in which a carburetor having an intake passageway extending laterally is connected to one side surface of an internal combustion engine with an insulator member interposed between the carburetor and the one side surface, and an air cleaner placed above the carburetor is connected to an upstream end of the carburetor, wherein the blow-by gas processing circuit comprises: a blow-by gas lead-out pipe rising upward from the internal combustion engine, and extending along one side surface of the air cleaner; an upper pipe bending laterally from an upper end of the blow-by gas lead-out pipe, and extending along the one side surface; a descending pipe bending downward from an extremity portion of the upper pipe, and extending along the one side surface so as to reach a purification completion chamber of the air cleaner; a branch pipe branching off downward from an intermediate portion of the upper pipe, and connected to a blow-by gas outlet port which is opened to an intake passage penetrating the insulator member; and a control valve placed in an upper portion of the branch pipe, and configured to open in accordance with a rise in boost negative pressure of the internal combustion engine.

According to the first aspect of the present invention, the blow-by gas processing circuit for an internal combustion engine includes: the blow-by gas lead-out pipe rising upward from the internal combustion engine, and extending along the one side surface of the air cleaner; the upper pipe bending laterally from the upper end of the blow-by gas lead-out pipe, and extending along the one side surface; the descending pipe bending downward from the extremity portion of the upper pipe, extending along the one side surface so as to reach the purification completion chamber of the air cleaner; the branch pipe branching off downward from the intermediate portion of the upper pipe, and connected to the blow-by gas outlet port which is opened to the intake passage penetrating the insulator member; and the control valve placed in the upper portion of the branch pipe, and configured to open in accordance with the rise in the boost negative pressure of the internal combustion engine. This makes it possible to easily adopt the blow-by gas processing circuit just by providing the blow-by gas outlet port to the insulator member which is a small component. In addition, the pipes can be compactly arranged along the one side surface of the air cleaner. Accordingly, the blow-by gas processing circuit is applicable to various types of internal combustion engines regardless of whether or not their intake pipes are long.

In addition, while the internal combustion engine is idling, a favorable air-fuel mixture can be produced in the branch pipe by mixing the blow-by gas and air filtered by the air cleaner together. This air-fuel mixture is sucked into the internal combustion engine through the intake passageway of the insulator member, and can be subjected to a combustion process effectively.

In addition, if condensation occurs in the blow-by gas processing circuit after the internal combustion engine stops its operation, water droplets in the upper pipe at the highest part in the blow-by gas processing circuit flow downward to the blow-by gas lead-out pipe or the descending pipe side, and go down in the blow-by gas lead-out pipe or the descending pipe. On the other hand, in the vertically extending branch pipe, the control valve is provided in the upper portion of the branch pipe. Accordingly, in some cases, a small amount of water droplets remain in a small space in the branch pipe above the control valve. However, the small amount of water droplets evaporate in a relatively short time due to heat radiation from the internal combustion engine, and do not become frozen even in cold weather. For this reason, it is possible to subject the blow-by gas to the combustion process by ensuring return of the blow-by gas into the internal combustion engine even while the internal combustion engine is in operation in cold weather.

According to a second aspect of the present invention, in addition to the first aspect, the blow-by gas outlet port is opened to the intake passage with its phase different from a phase of a valve shaft of a butterfly throttle valve configured to open and close the intake passageway of the carburetor.

According to the second aspect of the present invention, the blow-by gas outlet port is opened to the intake passage with its phase different from that of the valve shaft of the butterfly throttle valve of the carburetor. The blow-by gas going out through the blow-by gas outlet port is well mixed with intake air passing through opening portions of the throttle valve because of their collision. It is thereby possible to facilitate the combustion process.

According to a third aspect of the present invention, in addition to the first aspect, the upper pipe is inclined in such a manner as to extend downward from the descending pipe side to the blow-by gas lead-out pipe side.

According to the third aspect of the present invention, the upper pipe is inclined in such a manner as to extend downward from the descending pipe side to the blow-by gas lead-out pipe side. Therefore, by making the water droplets, once produced in the upper pipe, flow downward to the blow-by gas lead-out pipe side quickly, stagnation of water droplets in the upper pipe can be resolved soon. In addition, attachment of dust to the throttle valve due to the water droplets can be precluded because: water droplets to flow into the purification completion chamber of the air cleaner are only a small amount of water droplets produced by the condensation in the descending pipe; and accordingly, few water droplets reach the throttle valve of the carburetor from the purification completion chamber no matter what orientation the internal combustion engine is in when it stops its operation.

According to a fourth aspect of the present invention, in addition to the first aspect, natural gas fuel is supplied to the internal combustion engine.

According to the fourth aspect of the present invention, the natural gas fuel is supplied to the internal combustion engine. For this reason, even if a relatively large amount of vapor is included in the blow-by gas, an amount of water droplets remaining in the blow-by gas processing circuit can be minimized by combustion of the natural gas fuel. Thus, the return of the blow-by gas into the internal combustion engine is ensured.

The above and other objects, characteristics and advantages of the present invention will be clear from detailed descriptions of the preferred embodiment which will be provided below while referring to the attached drawings.

DESCRIPTION OF THE PREFERRED EMBODIMENT

Descriptions will be provided below for an embodiment of the present invention on the basis of the accompanying drawings.

Figure 1:
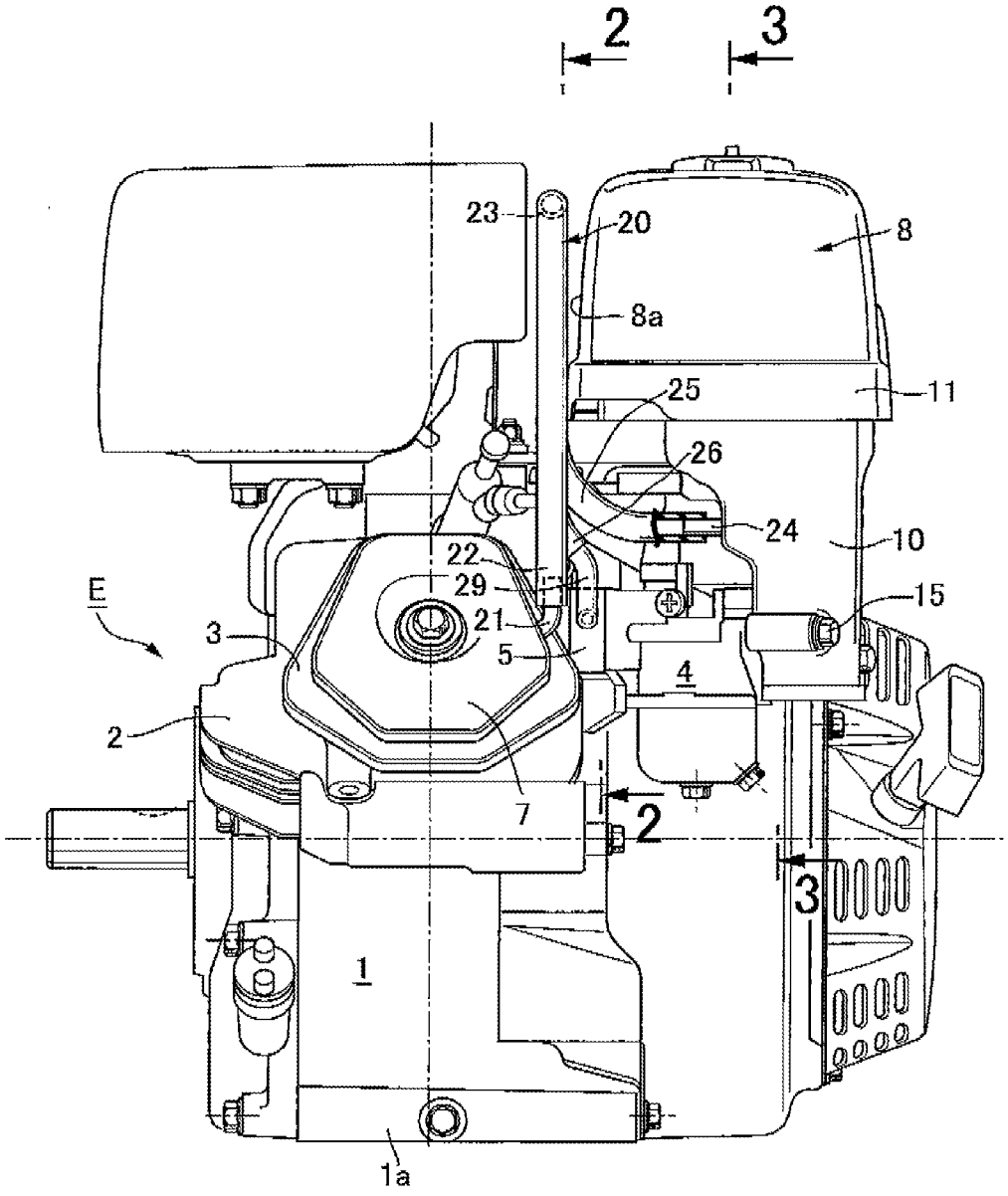
FIG. 1 is an elevation view of a general-purpose internal combustion engine according to an embodiment of the present invention.
Figure 2:
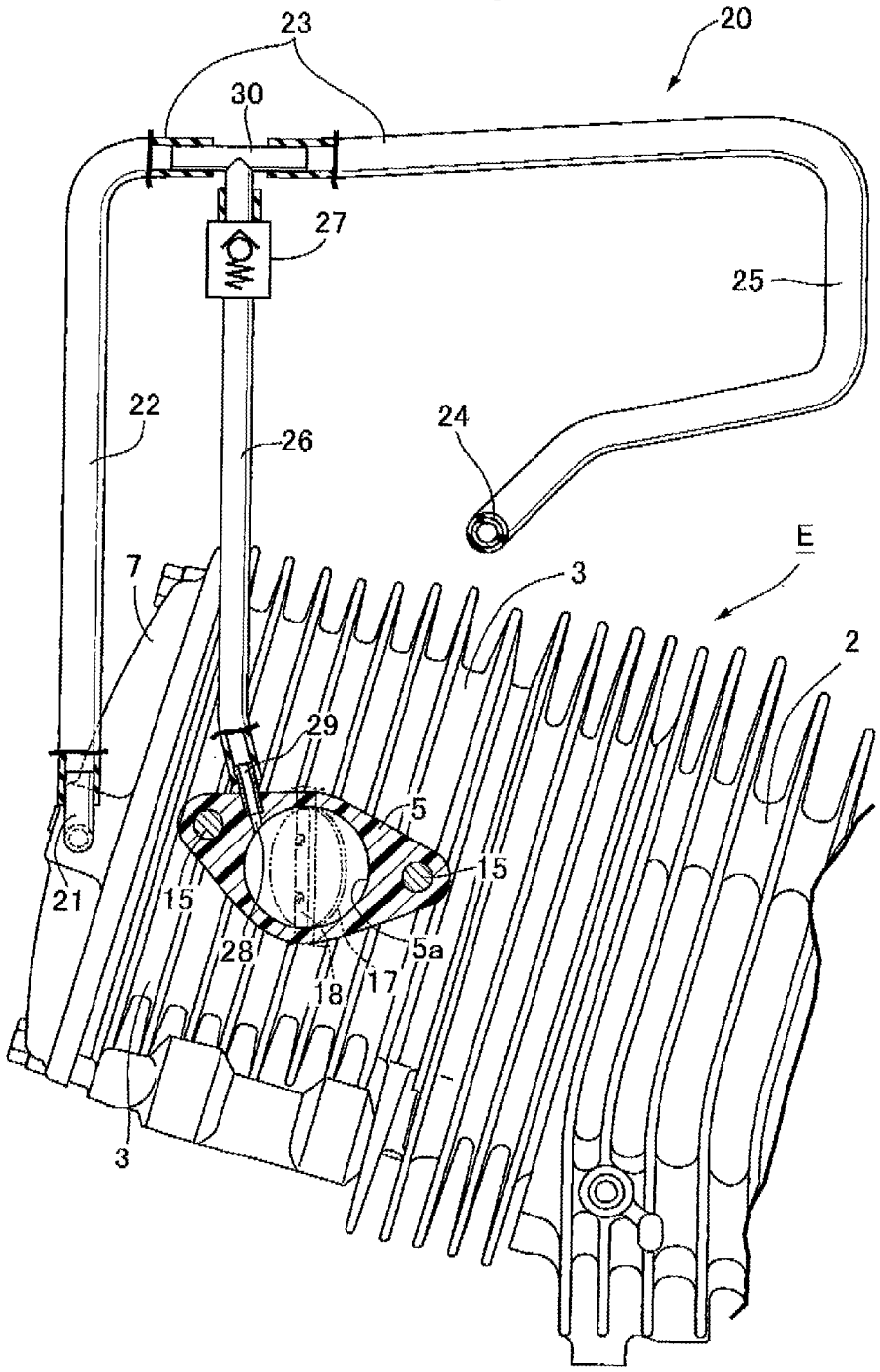
FIG. 2 is a sectional view taken along a line 2-2 in FIG. 1.

First of all, referring to FIG. 1 and FIG. 2, a general-purpose internal combustion engine E for driving a power generator and other types of working machines includes: a crankcase 1 having an installation flange 1*a* at its lower end; a cylinder block 2 continuously mounted on an upper portion of the crankcase 1, and tilting to one side of the crankcase 1; and a cylinder head 3 continuously mounted on an upper end of the cylinder block 2. A carburetor 4 is attached to one side surface of the cylinder head 3, where an intake port is opened, with a synthetic resin-made insulator member 5 interposed between the carburetor 4 and the one side surface. The carburetor 4 includes a laterally-extending intake passageway 4*a*. An air cleaner 8 placed above the carburetor 4 is connected to an upstream end of the intake passageway 4*a*.

Figure 3:
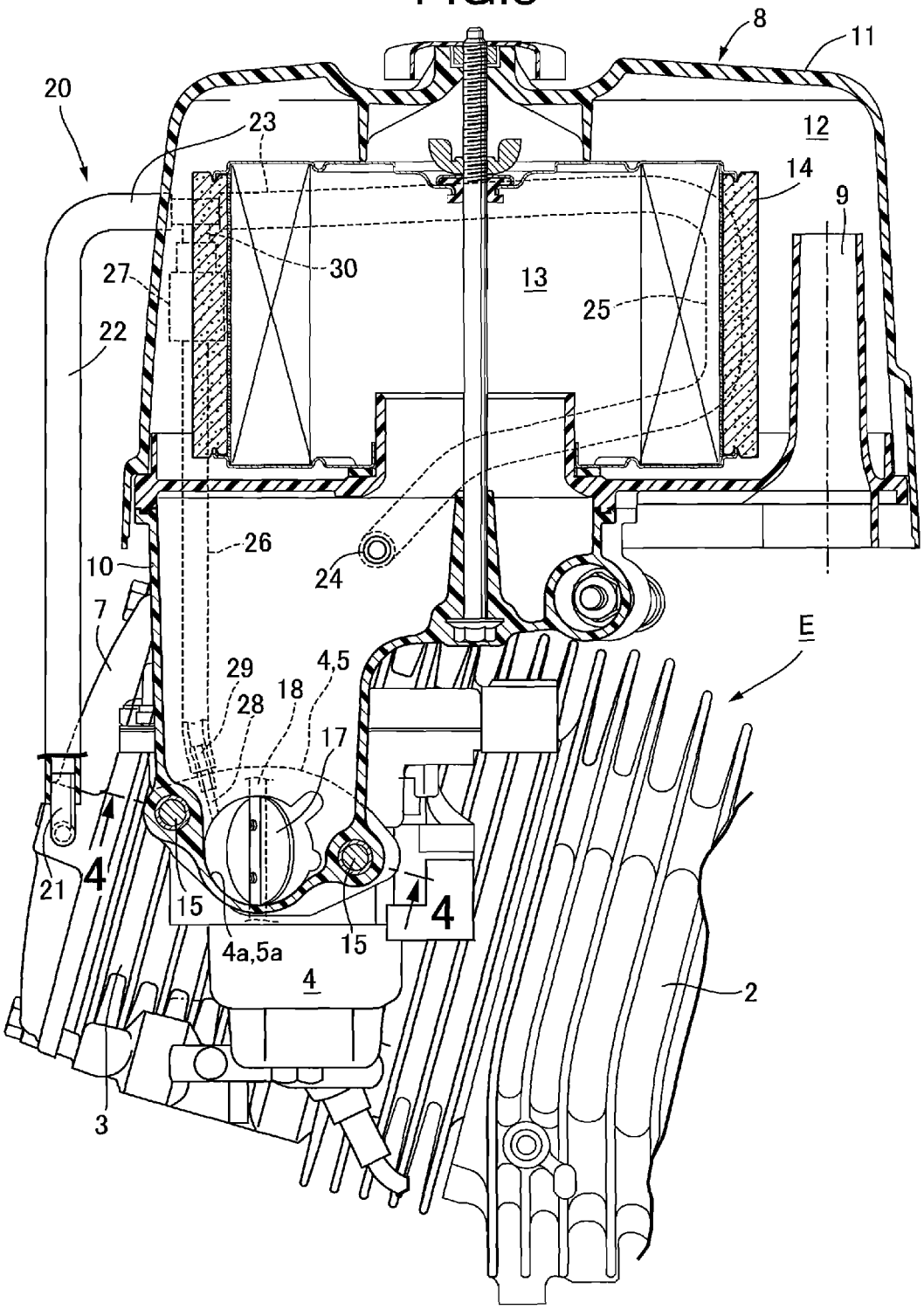
FIG. 3 is a sectional view taken along a line 3-3 in FIG. 1.

As shown in FIG. 3, the air cleaner 8 includes: a cleaner case 11 having an air inlet pipe 9 and an air outlet pipe 10; and a cylinder-shaped cleaner element 14 placed inside the cleaner case 11, and configured to partition an interior of the cleaner case 11 into a pre-purification chamber 12 communicating with the air inlet pipe 9 and a purification completion chamber 13 communicating with the air outlet pipe 10. Air flowing into the pre-purification chamber 12 through the air inlet pipe 9 is purified while passing through the cleaner element 14.

Figure 4:
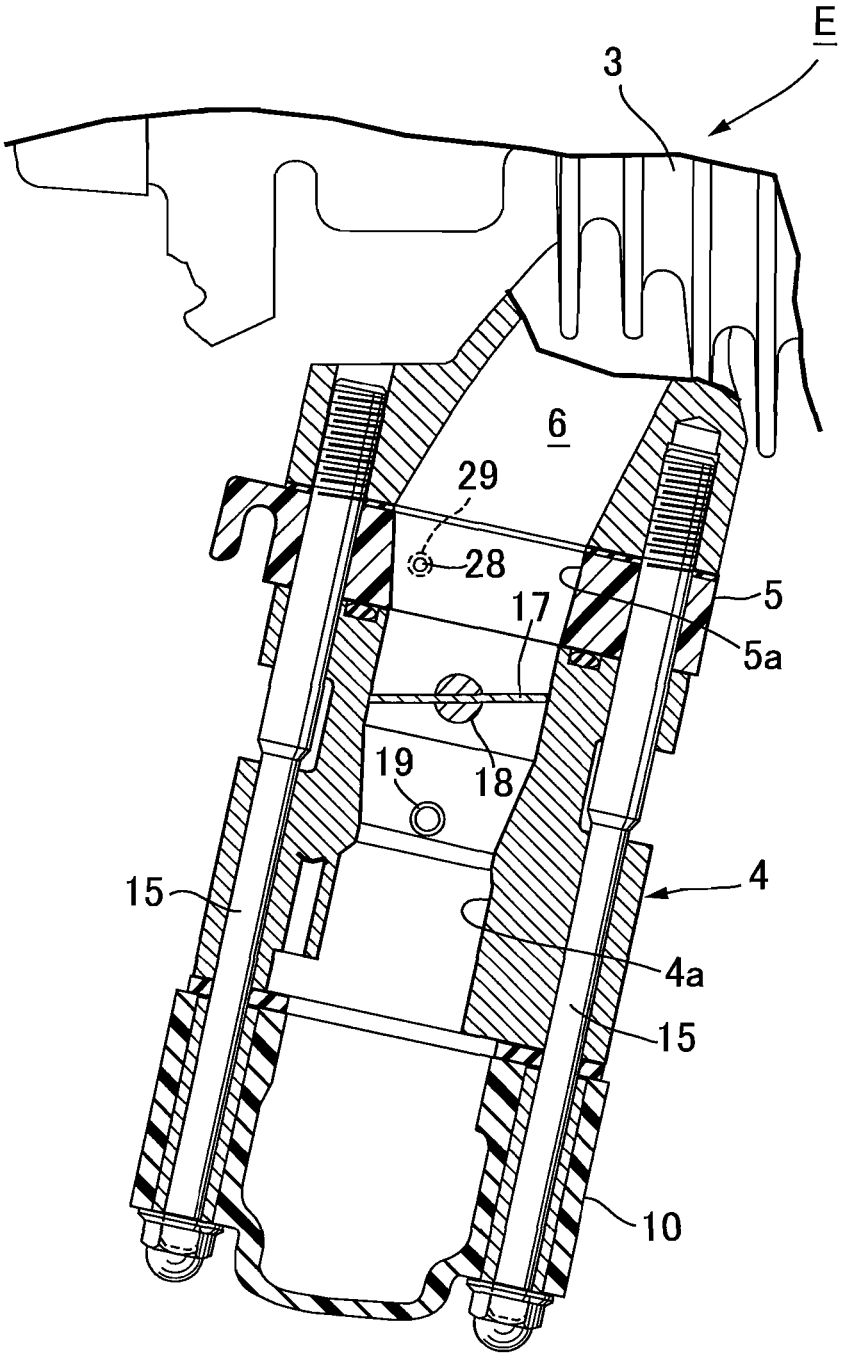
FIG. 4 is a sectional view taken along a line 4-4 in FIG. 3.

Referring to FIG. 4, the intake port 6 is opened in the one side surface of the cylinder head 3. The synthetic resin-made insulator member 5, the carburetor 4 and a downstream end portion of the air outlet pipe 10 are joined, in this order, to the side surface of the cylinder head 3. These components are fastened to the cylinder head 3 by use of a pair of through bolts 15 which penetrate these components and are threadedly attached to the cylinder head 3. The insulator member 5 includes an intake passage 5*a* through which the intake passageway 4*a* of the carburetor 4 communicates with the intake port 6. The carburetor 4 rotatably supports a valve shaft 18 of a butterfly throttle valve 17 for opening and closing the intake passageway 4*a*. A nozzle 19 through which to inject natural gas fuel is provided to the intake passageway 4*a* in a vicinity of the throttle valve 17. Accordingly, the internal combustion engine E uses the natural gas as its fuel.

Referring to FIG. 1 to FIG. 3, a blow-by gas generated inside the crankcase 1 of the internal combustion engine E is conveyed to a gas/liquid separating chamber (not illustrated) which is formed inside a head cover 7 of the cylinder head 3. After separation of oil mists therefrom, the blow-by gas is directed to a blow-by gas processing circuit 20 connected to the head cover 7.

The blow-by gas processing circuit 20 includes: a blow-by gas lead-out pipe 22 connected to a first joint pipe 21 of the head cover 7, rising upward, and extending along one side surface 8*a* of the air cleaner 8; an upper pipe 23 bending laterally from an upper end of the blow-by gas lead-out pipe 22, and extending along the one side surface 8*a* of the air cleaner 8; a descending pipe 25 bending downward from an extremity portion of the upper pipe 23, extending along the one side surface 8*a* of the air cleaner 8, and connected to a second joint pipe 24 of the air outlet pipe 10; and a branch pipe 26 branching off downward from an intermediate portion of the upper pipe 23. The branch pipe 26 is connected to a blow-by gas outlet port 28, which is opened to the intake passage 5*a* of the insulator member 5 with a second joint pipe 29 interposed between the branch pipe 26 and the blow-by gas outlet port 28. A control valve 27 is placed at a highest possible portion of the branch pipe 26. The control valve 27 is configured to open in accordance with a rise in boost negative pressure of the internal combustion engine E. Thus, the blow-by gas processing circuit 20 is arranged adjacent to and along the one side surface 8*a* of the air cleaner 8. A T-joint pipe 30 is used to connect the upper pipe 23 and the branch pipe 26 together. The placement of the control valve 27 at the highest possible portion of the branch pipe 26 means that the control valve 27 is placed adjacent to the T-joint pipe 30.

In the foregoing configuration, the blow-by gas outlet port 28 is opened to the intake passage 5*a* with its phase different from that of the valve shaft 18 of the carburetor 4. The upper pipe 23 is inclined in such a manner as to extend downward from the descending pipe 25 side to the blow-by gas lead-out pipe 22 side.

Next, operations of this embodiment will be described.

Figure 5A:
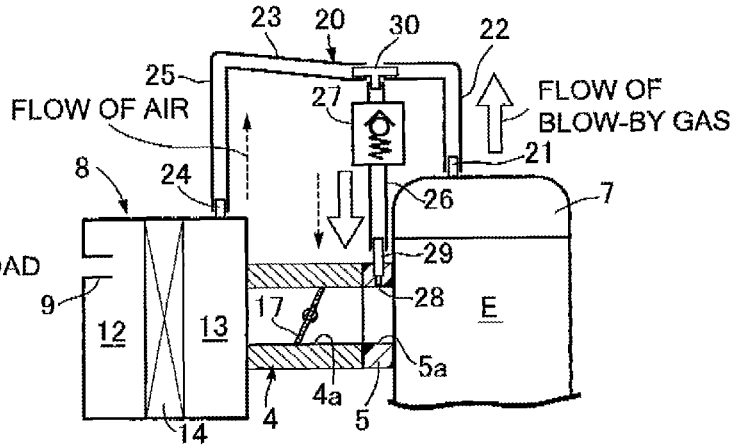
FIGS. 5A to 5C are schematic operation explanatory views of a blow-by gas processing circuit.
Figure 5B:
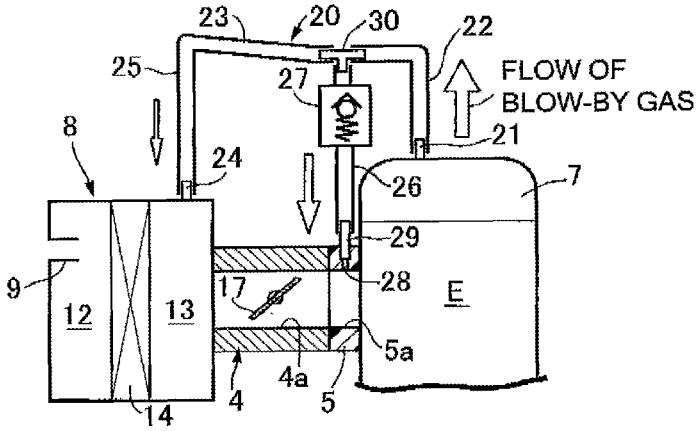
Figure 5C:
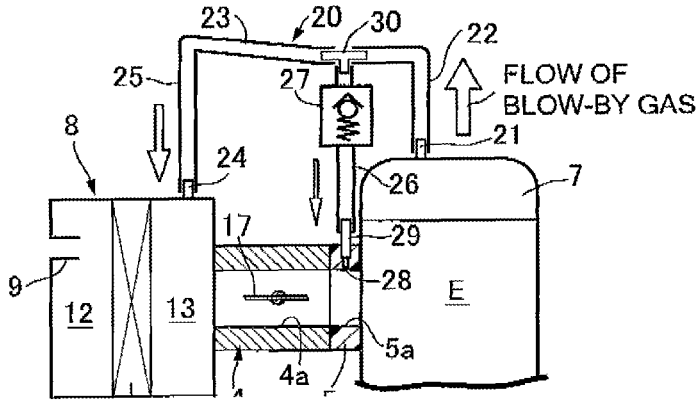

FIGS. 5A to 5C are schematic views showing operations of the blow-by gas processing circuit 20. FIG. 5A shows how the blow-by gas processing circuit 20 works during an idle to low-load operation of the internal combustion engine E with the throttle valve 17 opened at an idle-opening to small-opening angle. FIG. 5B shows how the blow-by gas processing circuit 20 works during a medium-load operation of the internal combustion engine E with the throttle valve 17 opened at a medium-opening angle. FIG. 5C shows how the blow-by gas processing circuit 20 works during a full-load operation of the internal combustion engine E with the throttle valve 17 opened fully.

During the idle to low-load operation of the internal combustion engine E shown in FIG. 5A, the control valve 27 is opened in a full-open state because intake negative pressure on a downstream side of the throttle valve 17, namely, the boost negative pressure rises. Accordingly, the blow-by gas generated in the internal combustion engine E passes through the blow-by gas lead-out pipe 22, a part of the upper pipe 23, the control valve 27, the branch pipe 26 and the blow-by gas outlet port 28, in this order; and is sucked into the intake passage 5*a* of the insulator member 5. Simultaneously, air which is purified by the air cleaner 8 starts at the purification completion chamber 13; passes through the descending pipe 25, the other part of the upper pipe 23 and the control valve 27; and flows into the branch pipe 26 to join the blow-by gas. The air mixed with the blow-by gas is sucked into the intake passage 5*a* through the blow-by gas outlet port 28. Thus, the air-fuel mixture in which the blow-by gas and the air are well mixed together is sucked into the internal combustion engine E, and is subjected to a combustion process successfully.

During the medium-load operation of the internal combustion engine E shown in FIG. 5B, the control valve 27 is put in a half-open state due to reduction in the boost negative pressure. For this reason, as in the case described above, most of the blow-by gas generated in the internal combustion engine E sequentially passes through the blow-by gas lead-out pipe 22, the part of the upper pipe 23, the control valve 27, the branch pipe 26 and the blow-by gas outlet port 28, in this order; and is sucked into the intake passage 5*a* of the insulator member 5. The rest of the blow-by gas passes through the upper pipe 23 and the descending pipe 25; and is sucked into the purification completion chamber 13 of the air cleaner 8; passes through a periphery of the throttle valve 17 together with the purified air; is sucked into the internal combustion engine E; and is subjected to the combustion process successfully.

During the full-load operation of the internal combustion engine E shown in FIG. 5C, the control valve 27 is slightly opened, because the boost negative pressure rises with an increase in an intake amount of the internal combustion engine E. For this reason, most of the blow-by gas generated in the internal combustion engine E passes through the same route as in the case shown in FIG. 5B, and is sucked into the internal combustion engine E. The rest of the blow-by gas passes through the same route as in the case shown in FIG. 5A; is sucked into the combustion engine E; and is subjected to the combustion process successfully.

During the operation of the internal combustion engine E, in the carburetor 4, the natural gas fuel is injected from the nozzle 19 in accordance with the opening angle of the throttle valve 17, and is mixed with the air which is purified by the air cleaner 8. The mixture is sucked into the internal combustion engine E, and is combusted to generate motive power.

The blow-by gas processing circuit 20 of the present invention includes: the blow-by gas lead-out pipe 22 rising upward from the head cover 7, and extending along the one side surface 8*a* of the air cleaner 8; the upper pipe 23 bending laterally from the upper end of the blow-by gas lead-out pipe 22, and extending along the one side surface 8*a*; the descending pipe 25 bending downward from the extremity portion of the upper pipe 23, extending along the one side surface 8*a* so as to reach the purification completion chamber 13 of the air cleaner 8; the branch pipe 26 branching off downward from the intermediate portion of the upper pipe 23, and connected to the blow-by gas outlet port 28 which is opened to the intake passage 5*a* penetrating the insulator member 5; and the control valve 27 placed at the highest possible portion of the branch pipe 26, and configured to open in accordance with the rise in the boost negative pressure of the internal combustion engine E. This makes it possible to easily adopt the blow-by gas processing circuit 20 to even the internal combustion engine E without a long intake pipe, just by providing the blow-by gas outlet port 28 and the second joint pipe 29 to the insulator member 5 which is a small component. Furthermore, the pipes 22, 23, 25, 26 can be placed compactly along the one side surface of the air cleaner 8. Thus, the blow-by gas processing circuit 20 is applicable to various types of internal combustion engines regardless of whether or not their intake pipes are long.

Since the natural gas fuel injected from the nozzle 19 generates a relatively large amount of moisture during its combustion, the blow-by gas also includes a relatively large amount of moisture (vapor). Therefore, when the internal combustion engine E stops its operation, in some cases, the vapor in the blow-by gas remaining in the pipes 22, 23, 25, 26 condenses into water droplets, and the water droplets adhere to inner surfaces of the respective pipes 22, 23, 25, 26. Such water droplets flow down in the corresponding pipes of 22, 23, 25, 26 by gravity.

Accordingly, water droplets in the upper pipe 23 at a highest part in the blow-by gas processing circuit 20 of the present invention flow toward an end portion of the upper pipe 23. The water droplets having moved to the blow-by gas lead-out pipe 22 flow into the head cover 7, while the water droplets having moved to the descending pipe 25 flow into the purification completion chamber 13 of the air cleaner 8.

Particularly, the upper pipe 23 is inclined in such a manner as to extend downward from the descending pipe 25 side to the blow-by gas lead-out pipe 22 side. Therefore, by making the water droplets, once produced in the upper pipe 23, flow downward to the blow-by gas lead-out pipe 22 side quickly, stagnation of water droplets in the upper pipe 23 can be resolved soon. In addition, attachment of dust to the throttle valve 17 due to the water droplets can be precluded because: water droplets to flow into the purification completion chamber 13 of the air cleaner 8 are only a small amount of water droplets produced by condensation in the descending pipe 25; and accordingly, few water droplets reach the throttle valve 17 of the carburetor 4 from the purification completion chamber 13 no matter what orientation the internal combustion engine is in when it stops its operation.

In the vertically extending branch pipe 26, meanwhile, a small amount of water droplets remain in a small space in the branch pipe 26 above the control valve 27, in some cases, since the control valve 27 is provided in the upper portion of the branch pipe 26. However, the small amount of water droplets evaporate in a relatively short time due to heat radiation from the internal combustion engine E, and do not become frozen even in cold weather.

For this reason, the blow-by gas processing circuit 20 enables the blow-by gas to be subjected to the combustion process by ensuring return of the blow-by gas into the internal combustion engine E, even while the internal combustion engine E is in operation in cold weather.

It should be noted that the present invention is not limited to the foregoing embodiment, and various design changes can be made within the scope not departing from the gist of the invention.

What is claimed is:

1. A blow-by gas processing circuit for an internal combustion engine, in which a carburetor having an intake passageway extending laterally is to be connected to one side surface of an internal combustion engine with an insulator member interposed between the carburetor and the one side surface of the engine, and an air cleaner placed above the carburetor is connected to an upstream end of the carburetor, wherein the air cleaner includes one side surface that is formed on a lateral portion of the air cleaner exposed to an outside and extends in an up-and-down direction, the blow-by gas processing circuit comprises:

a blow-by gas lead-out pipe which is configured to rise upward from the internal combustion engine, and run along the one side surface of the air cleaner;

an upper pipe bending laterally from an upper end of the blow-by gas lead-out pipe, and running along the one side surface of the air cleaner;

a descending pipe bending downward from an extremity portion of the upper pipe, and running along the one side surface of the air cleaner so as to reach a purification completion chamber of the air cleaner;

a branch pipe branching off downward from an intermediate portion of the upper pipe, running along the one side surface of the air cleaner, and connected to a blow-by gas outlet port which is opened to an intake passage penetrating the insulator member; and a control valve placed in an upper portion of the branch pipe, and configured to open in accordance with a rise in boost negative pressure of the internal combustion engine, wherein substantial portions of the blow-by gas lead-out pipe, the upper pipe, the descending pipe and the branch pipe are aligned in one direction orthogonal to a running direction of the intake passageway.

2. The blow-by gas processing circuit for an internal combustion engine of claim 1, wherein the blow-by gas outlet port is opened to the intake passage at a position where the blow-by gas outlet port is not directed to a valve shaft of a butterfly throttle valve configured to open and close the intake passageway of the carburetor.

3. The blow-by gas processing circuit for an internal combustion engine of claim 1, wherein the upper pipe is inclined in such a manner as to extend downward from the descending pipe side to the blow-by gas lead-out pipe side.

4. The blow-by gas processing circuit for an internal combustion engine of claim 1, wherein natural gas fuel is supplied to the internal combustion engine.

5. The blow-by gas processing circuit for an internal combustion engine of claim 1, wherein the one side surface is an outside surface of the air cleaner.

6. The blow-by gas processing circuit for an internal combustion engine of claim 1, wherein the air cleaner has a pre-purification chamber and a purification completion chamber which are partitioned from each other by a cleaner element, an air outlet pipe leading to the carburetor communicates with the purification completion chamber, and the descending pipe is connected to the air outlet pipe.

7. An internal combustion engine equipped with the blow-by gas processing circuit of claim 1, wherein the air cleaner includes a cleaner case and an interior of the cleaner case is partitioned by a cleaner element into a pre-purification chamber and the purification completion chamber which are separated from each other, and an air outlet pipe which is in communication with the purification completion chamber is formed at a lower part of the cleaner case, the air outlet pipe being arranged to be opposed to the one side surface of the internal combustion engine, the intake passageway of the carburetor extending laterally therebetween and being connected to the air outlet pipe and the one side surface of the internal combustion engine.

* * * * *